US011627846B2

(12) United States Patent
Nielsen

(10) Patent No.: US 11,627,846 B2
(45) Date of Patent: Apr. 18, 2023

(54) SANITARY WIPE DISPENSING ASSEMBLY

(71) Applicant: Eric Nielsen, Carol Stream, IL (US)

(72) Inventor: Eric Nielsen, Carol Stream, IL (US)

( * ) Notice: Subject to any disclaimer, the term of this patent is extended or adjusted under 35 U.S.C. 154(b) by 0 days.

(21) Appl. No.: 17/346,814

(22) Filed: Jun. 14, 2021

(65) Prior Publication Data

US 2022/0395146 A1 Dec. 15, 2022

(51) Int. Cl.

*A47K 10/42* (2006.01)
*A47K 10/38* (2006.01)
*A47K 10/32* (2006.01)

(52) U.S. Cl.

CPC ..... *A47K 10/424* (2013.01); *A47K 10/38* (2013.01); *A47K 2010/3233* (2013.01); *A47K 2010/3266* (2013.01); *A47K 2010/389* (2013.01)

(58) Field of Classification Search

CPC ..... A47K 10/38; A47K 10/424; A47K 2010/389; A47K 2010/3233; A47K 2010/3266

See application file for complete search history.

(56) References Cited

U.S. PATENT DOCUMENTS 2,767,945 A * 10/1956 Bragg ..... A47K 10/38 248/231.9
4,106,617 A * 8/1978 Boone ..... A47K 10/3818 206/812
5,248,105 A * 9/1993 Cooker ..... A47K 10/38 D6/519
7,128,235 B2 10/2006 Haddad
9,271,616 B2 3/2016 Yaros
D844,345 S 4/2019 Williams
2002/0190073 A1* 12/2002 Hewett ..... A47K 10/46 221/46
2007/0181594 A1 8/2007 Thompson
2009/0206102 A1* 8/2009 Beck ..... A47K 10/40 221/45
2012/0097701 A1* 4/2012 Benedetti ..... A47K 10/32 221/283
2017/0245699 A1 8/2017 Keily
2020/0085249 A1* 3/2020 Sutterer ..... A47K 10/38
2020/0100631 A1 4/2020 Adams

FOREIGN PATENT DOCUMENTS

WO WO2017218125 12/2017

* cited by examiner

*Primary Examiner* — Gene O Crawford
*Assistant Examiner* — Kelvin L Randall, Jr.

(57) ABSTRACT

A sanitary wipe dispensing assembly for positioning sanitary wipes proximate to a toilet includes a box has a rear facet, a front facet, opposed vertical facets, and opposed horizontal facets. One of the front facet, the opposed vertical facets, and a first one of the opposed horizontal facets is open for insertion of a container of sanitary wipes. The box can be mounted to a substantially vertical surface proximate to a toilet so that the rear facet abuts the substantially vertical surface. An aperture is positioned in a second one of the opposed horizontal facets. A sanitary wipe protruding through the aperture can be grasped and pulled by a user to dispense it from the container for use in maintaining personal hygiene.

16 Claims, 9 Drawing Sheets

SANITARY WIPE DISPENSING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to dispensing assemblies and more particularly pertains to a new dispensing assembly for positioning sanitary wipes proximate to a toilet. The present invention discloses a dispensing assembly comprising a box, which is configured for dispensing sanitary wipes from an aperture positioned in a bottom of the box. The box may be integral to a toilet paper holder, or it may be mountable to a mounting plate that is separate from, or integral to, the toilet paper holder.

(2) Description of Related Art Including Information Disclosed Under 37 CFR 1.97 and 1.98

The prior art relates to dispensing assemblies. Prior art dispensing assemblies may mount to existing toilet paper dispensers or may provide a bracket for holding a container of sanitary wipes. What is lacking in the prior art is a dispensing assembly comprising a box configured for dispensing sanitary wipes from an aperture positioned in a bottom of the box. The box may be integral to a toilet paper holder, or it may be mountable to a mounting plate that is separate from, or integral to, the toilet paper holder.

BRIEF SUMMARY OF THE INVENTION

An embodiment of the disclosure meets the needs presented above by generally comprising a box has a rear facet, a front facet, opposed vertical facets, and opposed horizontal facets. One of the front facet, the opposed vertical facets, and a first one of the opposed horizontal facets is open and thus is configured for insertion of a container of sanitary wipes. The box is configured to be mounted to a substantially vertical surface proximate to a toilet so that the rear facet abuts the substantially vertical surface. An aperture is positioned in a second one of the opposed horizontal facets. The aperture is configured for protrusion of a sanitary wipe. The sanitary wipe can be grasped and pulled by a user to dispense it from the container for use in maintaining personal hygiene.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
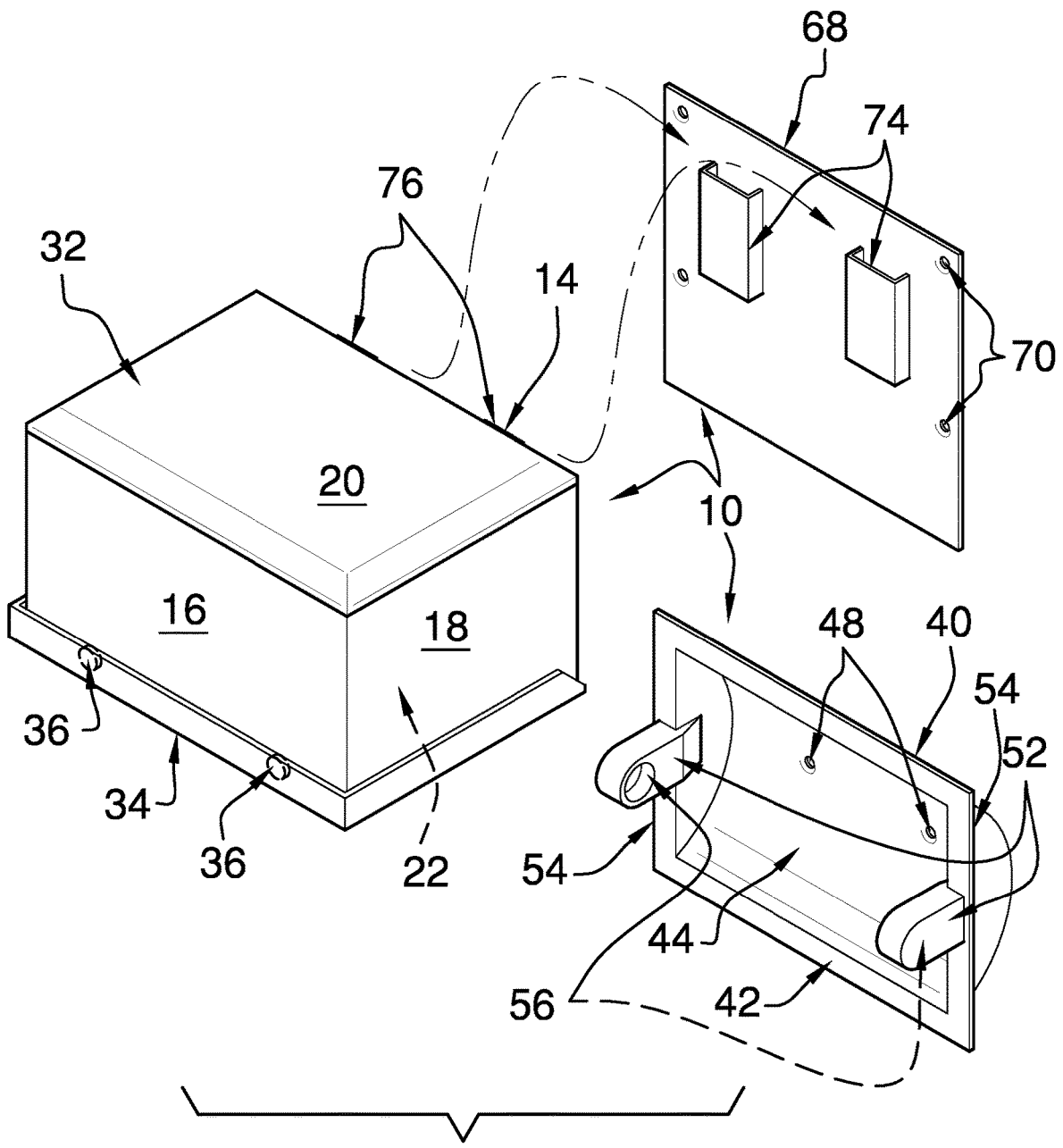
FIG. 1 is an isometric perspective view of a sanitary wipe dispensing assembly according to an embodiment of the disclosure.

With reference now to the drawings, and in particular to FIGS. 1 through 9 thereof, a new dispensing assembly embodying the principles and concepts of an embodiment of the disclosure and generally designated by the reference numeral 10 will be described.

As best illustrated in FIGS. 1 through 9, the sanitary wipe dispensing assembly 10 generally comprises a box 12 has a rear facet 14, a front facet 16, opposed vertical facets 18, and opposed horizontal facets 20. One of the front facet 16, the opposed vertical facets 18, and a first one 28 of the opposed horizontal facets 20 is open and thus is configured for insertion of a container 22 of sanitary wipes 24. The box 12 is configured to be mounted to a substantially vertical surface proximate to a toilet so that the rear facet 14 abuts the substantially vertical surface.

An aperture 26 is positioned in a second one 30 of the opposed horizontal facets 20. The aperture 26 is configured for protrusion of a sanitary wipe 24. The sanitary wipe 24 can be grasped and pulled by a user to dispense it from the container 22 for use in maintaining personal hygiene. As shown in the FIG. 7, the first one 28 of the opposed horizontal facets 20 is open with the aperture 26 being opposingly positioned in the box 12.

Figure 6:
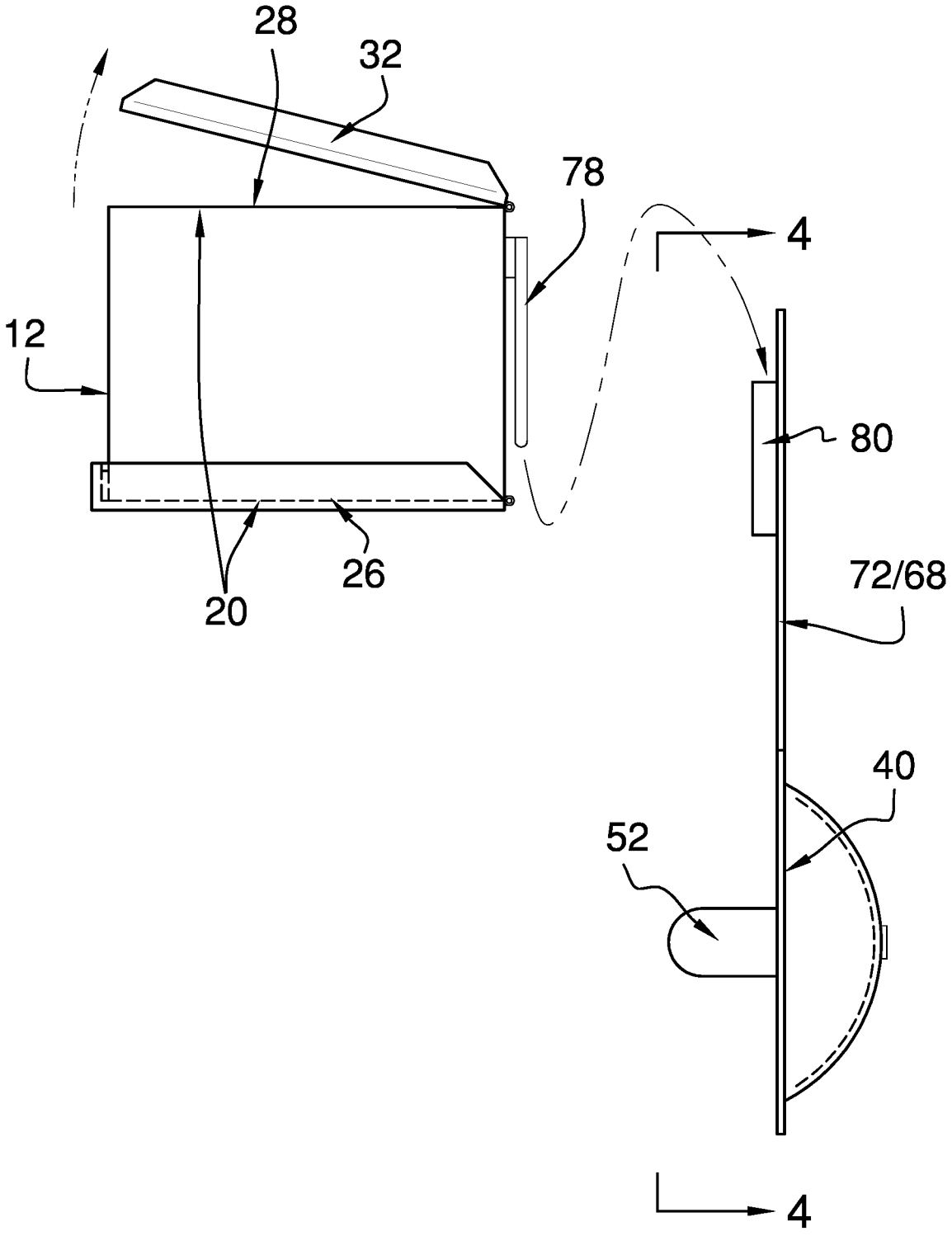
FIG. 6 is a side view of an embodiment of the disclosure.
Figure 7:
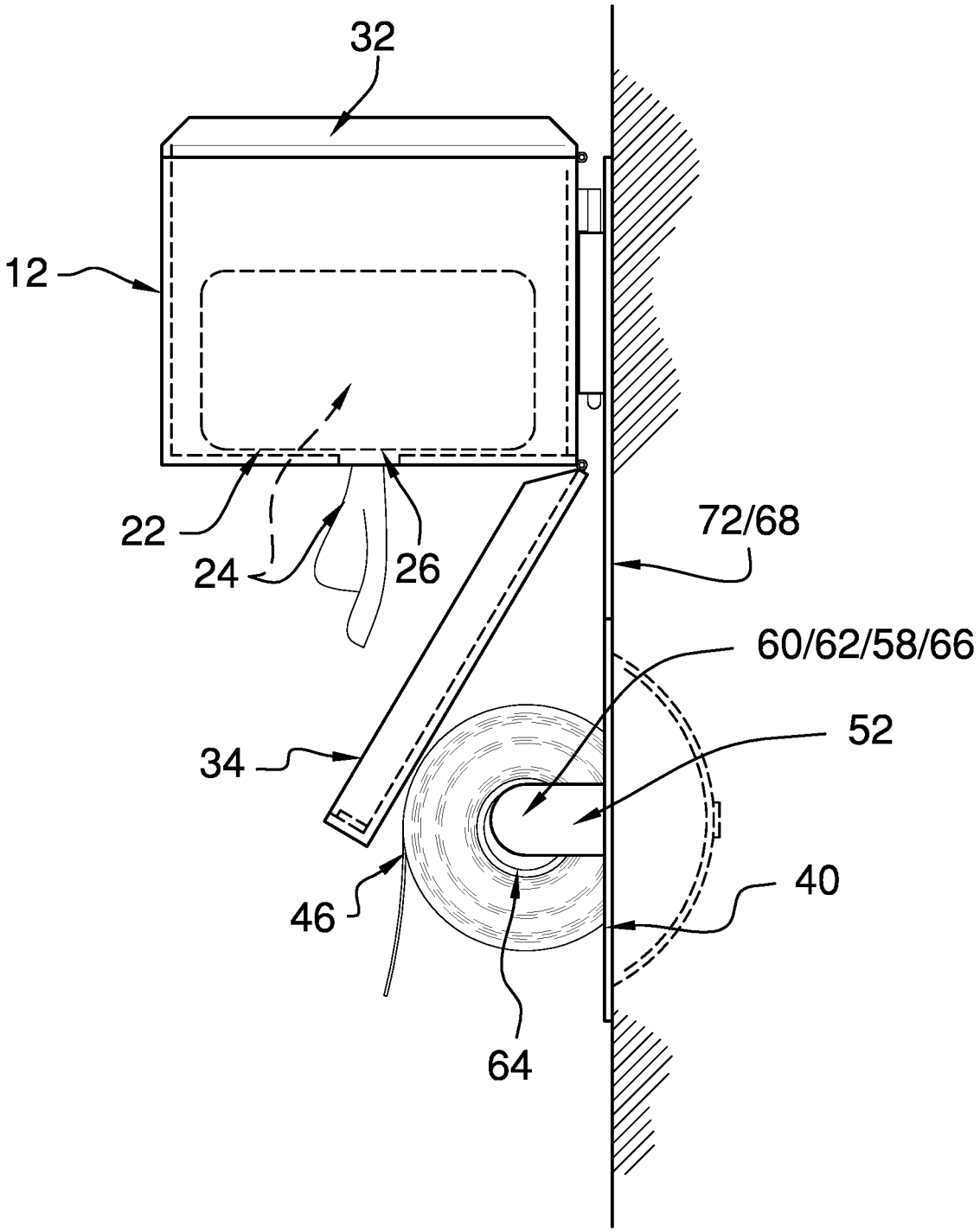
FIG. 7 is a side in-use view of an embodiment of the disclosure.
Figure 8:
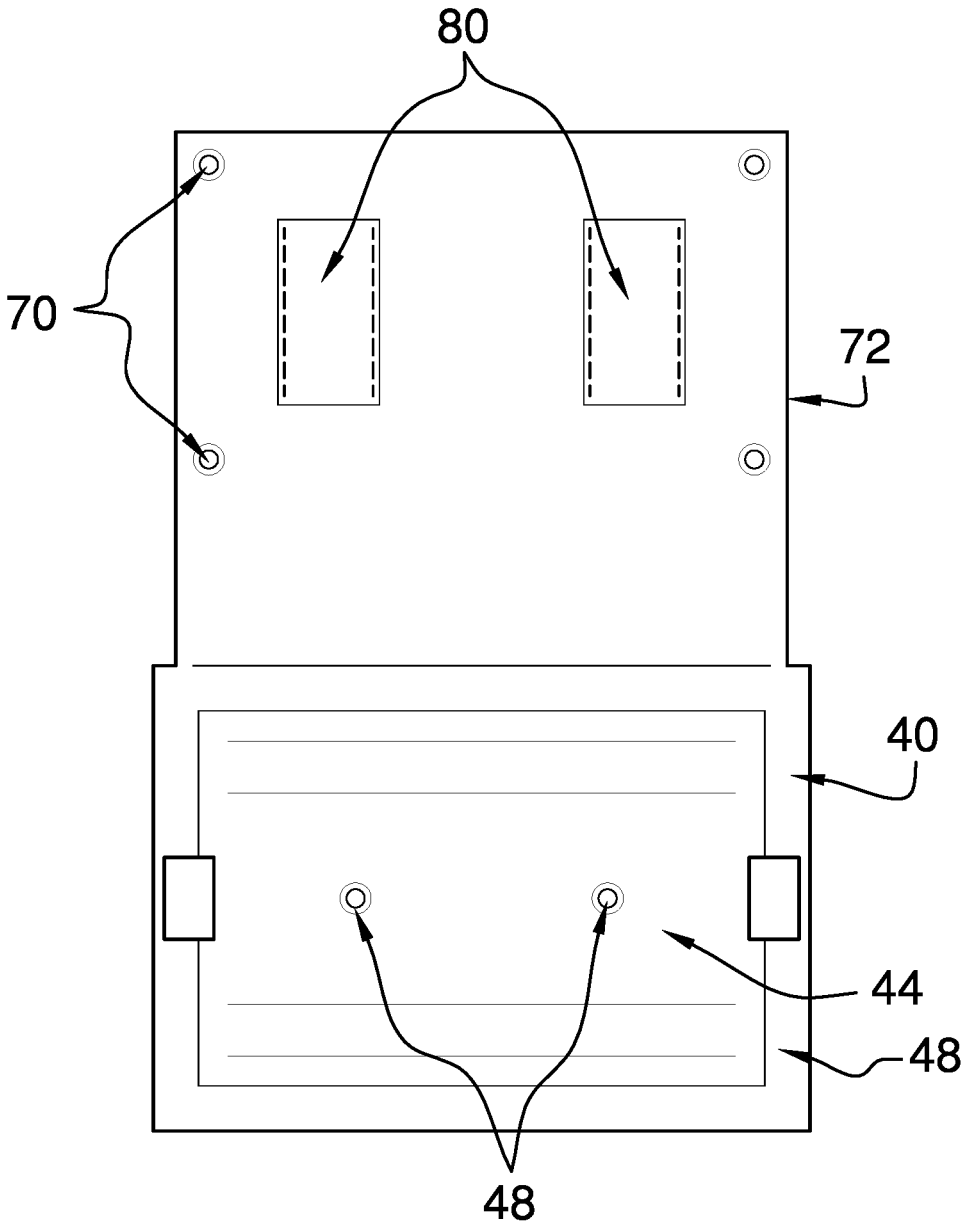
FIG. 8 is a front view of an embodiment of the disclosure.
Figure 9:
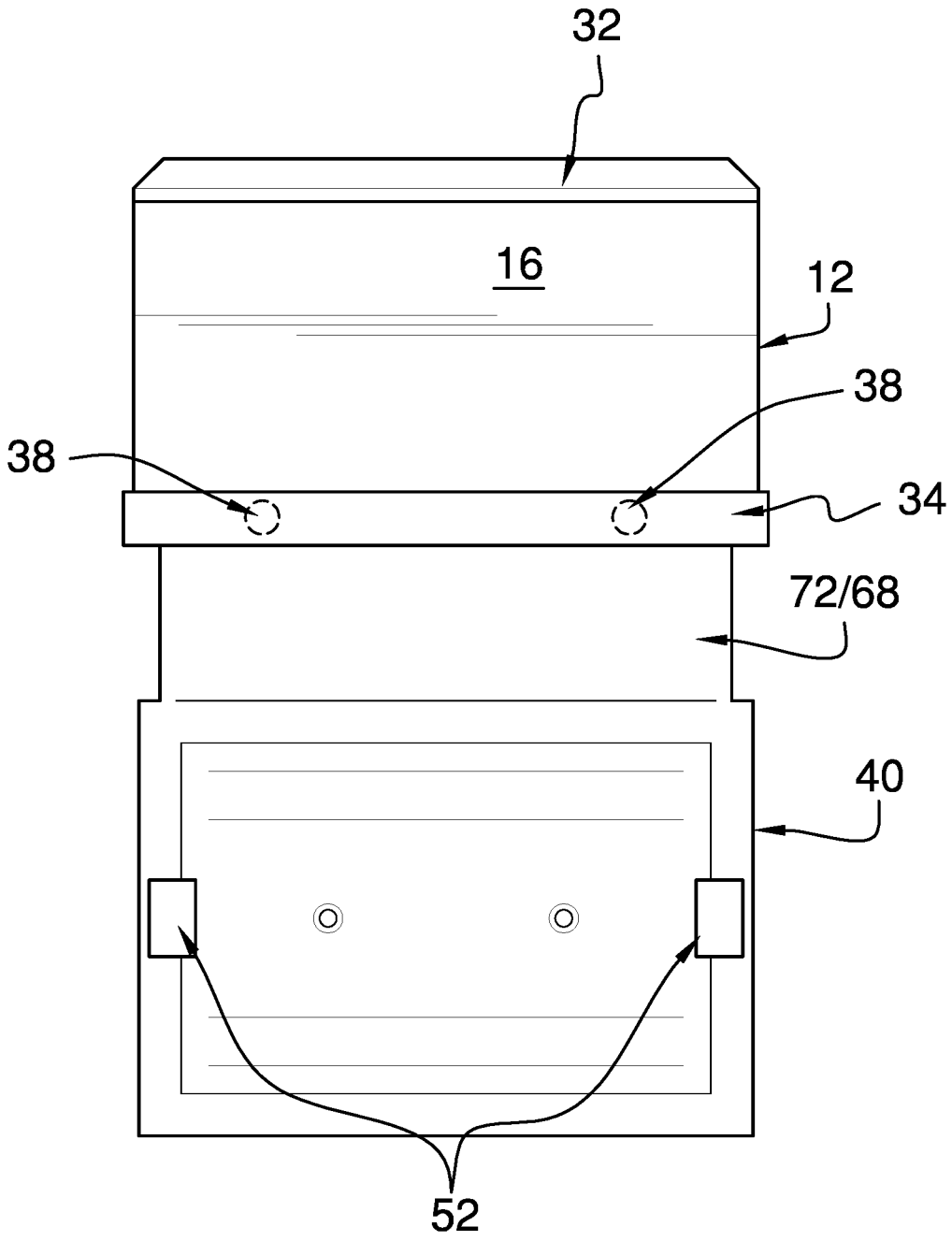
FIG. 9 is a front view of an embodiment of the disclosure.

As shown in FIG. 6, a lid 32 is hingedly engaged to the box 12 and is selectively engageable to the box 12 to selectively cover the open one of the front facet 16, the opposed vertical facets 18, and the first one 28 of the opposed horizontal facets 20. A cover 34 is hingedly engaged to the box 12 and is selectively engageable to the box 12 to selectively cover the aperture 26 and a sanitary wipe 24 protruding through the aperture 26, as shown in FIG. 7. The cover 34 and the lid 32 are configured to retain moisture in the sanitary wipes 24.

A fastener 36 is engaged to one of the box 12 and the cover 34 and is configured to selectively engage the other of the box 12 and the cover 34. The fastener 36 is positioned to secure the cover 34 over the aperture 26. The fastener 36 may comprise a magnet 38, or other fastening means, such as, but not limited to, latches, spring-loaded pins, and the like.

Figure 3:
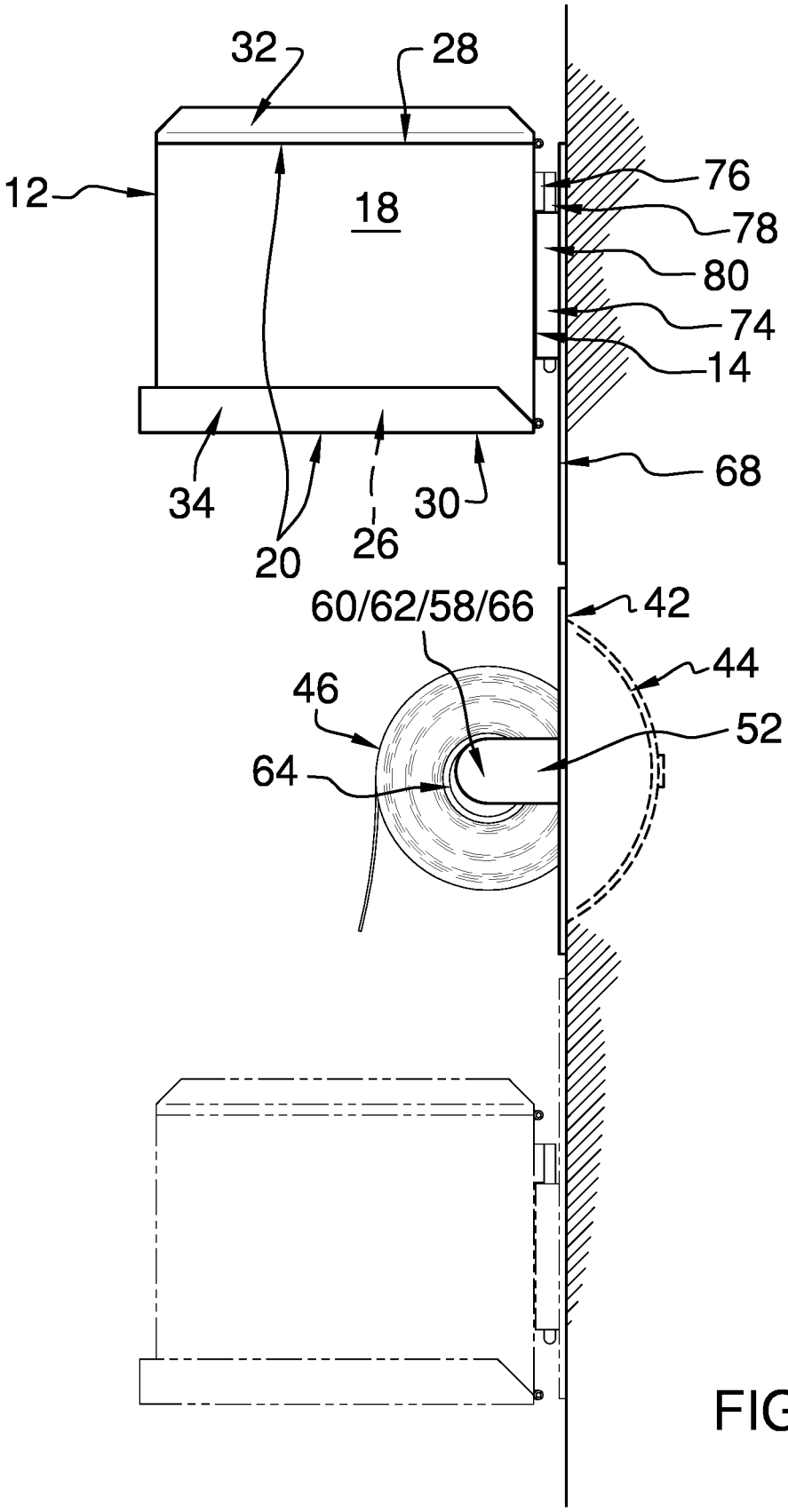
FIG. 3 is a side in-use view of an embodiment of the disclosure.

The sanitary wipe 24 dispensing assembly 10 also may comprise a holder plate 40, as shown in FIG. 1, which is configured to be mounted to a substantially vertical surface proximate to the toilet, as shown in FIG. 3. The holder plate 40 may comprise a perimeter section 42 and a center section 44. The center section 44 extends arcuately from the perimeter section 42 so that the center section 44 is shaped complementarily to a portion of a roll of toilet paper 46, as shown in FIG. 3. The present invention also anticipates the holder plate 40 being flat.

Figure 4:
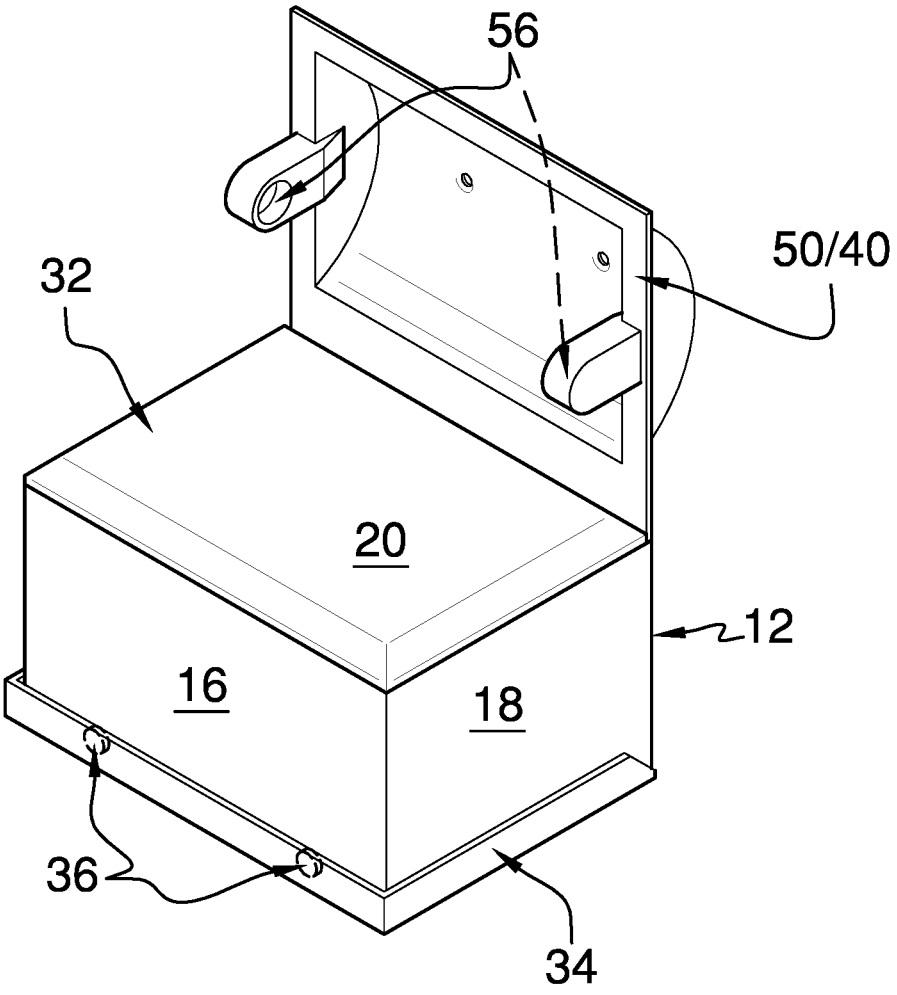
FIG. 4 is an isometric perspective view of an embodiment of the disclosure.
Figure 5:
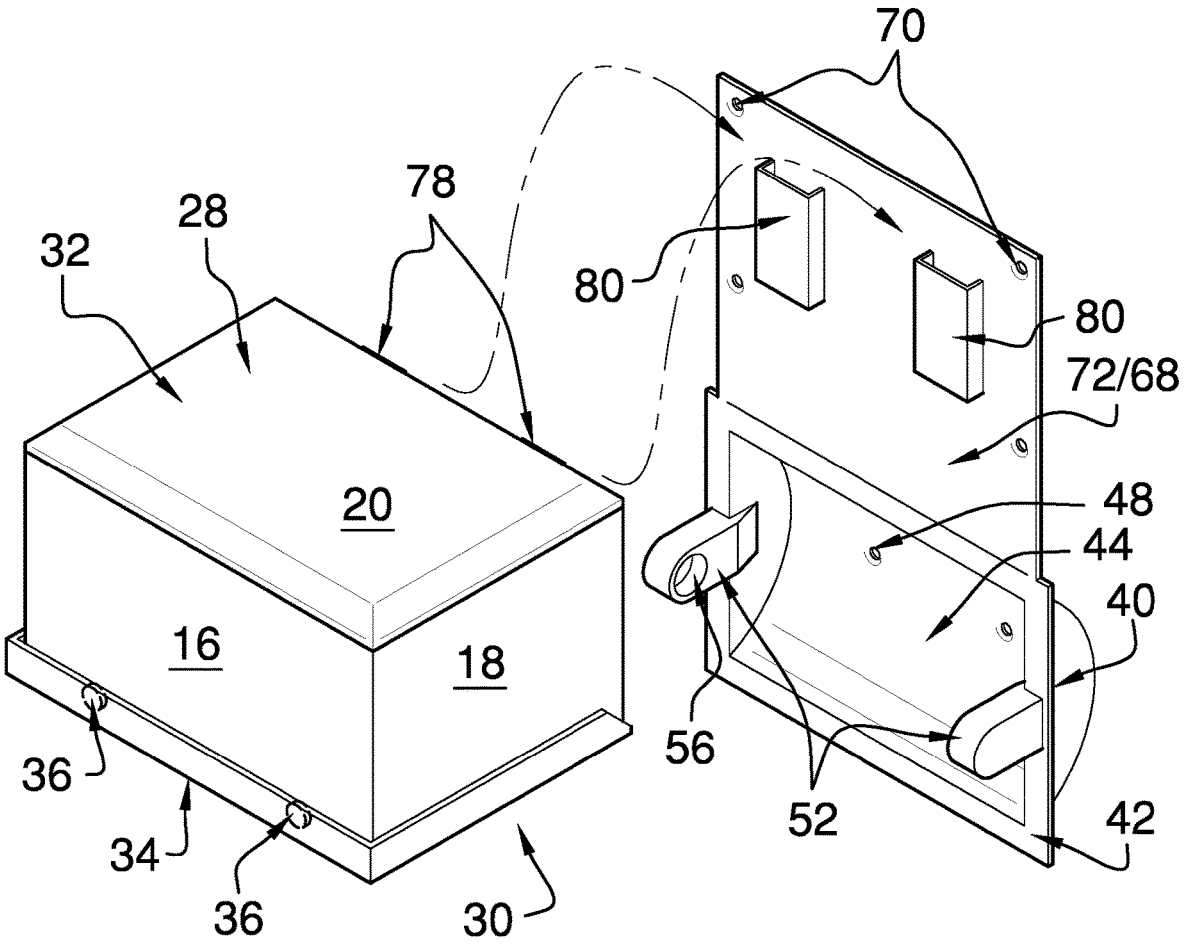
FIG. 5 is an isometric perspective view of an embodiment of the disclosure.

A plurality of holes 48 is positioned in the holder plate 40 and is configured for insertion of mounting hardware (not shown) to secure the holder plate 40 to the substantially vertical surface proximate to the toilet. The holder plate 40 may comprise an extension 50 of the rear facet 14, as shown in FIG. 4.

Each of a pair of arms 52 is engaged to and extends from a respective opposed side 54 of the holder plate 40. Each of a pair of recesses 56 is positioned in a respective arm 52, distal from the holder plate 40, so that the recesses 56 are facing. A spring 58 is positioned in a cylinder 60, which is hollow and which comprises a pair of nested segments 62. The spring 58 is engaged to each of the nested segments 62 such that the cylinder 60 is biased to an elongated configuration. The cylinder 60 is configured for insertion through a tube 64 of the roll of toilet paper 46. The spring 58 is configured to be compressed, positioning the cylinder 60 for placement between the arms 52 so that opposed ends 66 of the cylinder 60 insert into the recesses 56 upon rebounding of the spring 58. The cylinder 60 thus is removably engaged to the arms 52.

Figure 2:
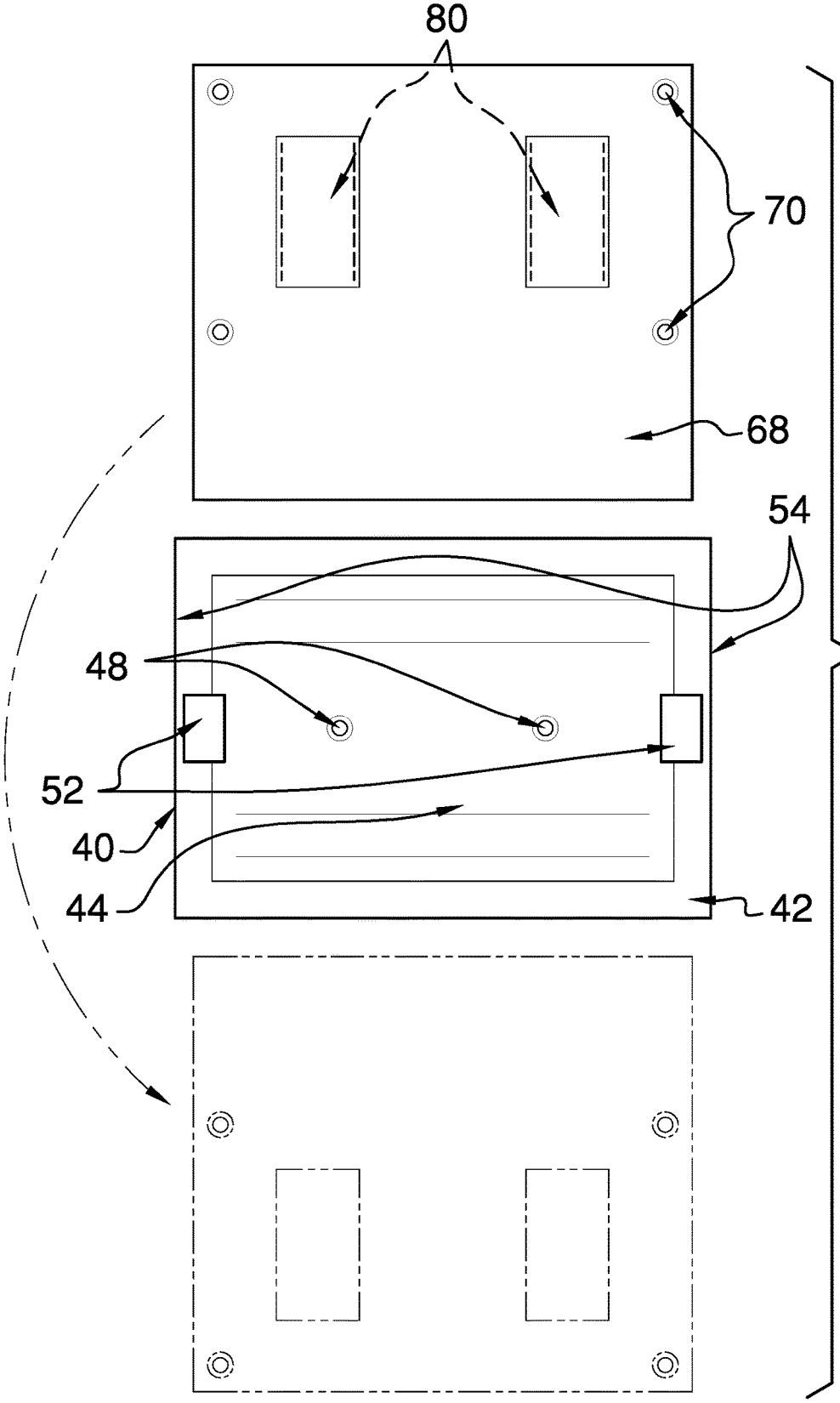
FIG. 2 is a front view of an embodiment of the disclosure.

The sanitary wipe 24 dispensing assembly 10 also may comprise a mounting plate 68, as shown in FIG. 1. The box 12 is configured to be mounted to the mounting plate 68. A plurality of orifices 70 is positioned in the mounting plate 68 and is configured for insertion of mounting hardware (not shown) to secure the mounting plate 68 to the substantially vertical surface proximate to the toilet. As shown in FIGS. 2 and 3, the mounting plate 68 can be positioned above or below the holder plate 40, or laterally of the holder plate (not shown).

The mounting plate 68 also may comprise an appendage 72 of the holder plate 40, as shown in FIG. 5-9. A first connector 74 is engaged to the appendage 72. A second connector 76 is engaged to the rear facet 14 of the box 12. The second connector 76 is complementary to the first connector 74 and thus is positioned to selectively engage the first connector 74 to removably engage the box 12 to the appendage 72. The second connector 76 may comprise a bracket 78 and the first connector 74 may comprise a bracket receiver 80.

In one example of use using the sanitary wipe 24 dispensing assembly 10 as depicted in FIG. 4, an existing toilet paper dispenser is removed from wall. The holder plate 40 then is positioned in a cavity vacated by the existing toilet paper dispenser and affixed to the wall by insertion of the mounting hardware through the holes 48. The lid 32 can be hinged open and a container 22 of sanitary wipes 24 inserted into the box 12, with a leading sanitary wipe 24 protruding through the aperture 26. As needed, the cover 34 can be hinged open to access a sanitary wipe 24.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A sanitary wipe dispensing assembly comprising:

a box having a rear facet, a front facet, opposed vertical facets, and opposed horizontal facets, one of the from facet, the opposed vertical facets, and a first one of the opposed horizontal facets being open and configured for insertion of a container of sanitary wipes, the box being configured for mounting to a substantially vertical surface proximate to a toilet, such that the rear facet abuts the substantially vertical surface;

an aperture positioned in a second one of the opposed horizontal facets wherein the aperture faces downwardly, wherein the aperture is configured for protrusion of a sanitary wipe;

a cover hingedly engaged to the box, the cover being selectively engageable to the box, such that the cover is positioned for selectively covering the aperture and a sanitary wipe protruding through the aperture, wherein the cover is configured for retaining moisture in the sanitary wipes;

a holder plate, the holder plate being configured for mounting to the substantially vertical surface proximate to the toilet and below the box;

a pair of arms, each arm being engaged to and extending from a respective opposed side of the holder plate;

a pair of recesses, each recess being positioned in a respective arm distal from the holder plate, such that the pair of recesses are facing;

a cylinder, the cylinder being hollow, the cylinder comprising a pair of nested segments;

a spring positioned in the cylinder and being engaged to each of the nested segments, such that the cylinder is biased to an elongated configuration, Wherein the cylinder is configured for insertion through a tube of a roll of toilet paper, wherein the spring is configured for compressing, positioning the cylinder for placement between the arms, such that opposed ends of the cylinder insert into the recesses upon rebounding of the spring, such that the cylinder is removably engaged to the arms; and wherein the cover is pivotally coupled to the box proximate the rear facet, the cover having a length extending away from the box such that the cover extends beyond the cylinder when pivoted whereby the cover is configured for extending between the sanitary wipe and the roll of toilet paper when the cover is pivoted.

2. The sanitary wipe dispensing assembly of claim 1, further including a lid hingedly engaged to the box, the lid being selectively engageable to the box, wherein the lid is configured for retaining moisture in the sanitary wipes.

3. The sanitary wipe dispensing assembly of claim 1, further including a fastener engaged to one of the box and the cover and being configured for selectively engaging the other of the box and the cover, such that the fastener is positioned for securing the cover over the aperture.

4. The sanitary wipe dispensing assembly of claim 3, wherein the fastener comprises a magnet.

5. The sanitary wipe dispensing assembly of claim 1, wherein the holder plate comprises a perimeter section and a center section, the center section extending arcuately from the perimeter section, such that the center section is shaped complementarily to a portion of a roll of toilet paper.

6. The sanitary wipe dispensing assembly of claim 1, further including a plurality of holes positioned in the holder plate, wherein the holes are configured for insertion of mounting hardware for securing the holder plate to the substantially vertical surface proximate to the toilet.

7. The sanitary wipe dispensing assembly of claim 1, wherein the holder plate comprises an extension of the rear facet.

8. The sanitary wipe dispensing assembly of claim 1, further including:

a mounting plate, the box being configured for mounting to the mounting plate, the mounting plate comprising an appendage of the holder plate; and a plurality of orifices positioned in the mounting plate, wherein the orifices are configured for insertion of mounting hardware for securing the mounting plate to the substantially vertical surface proximate to the toilet.

9. The sanitary wipe dispensing assembly of claim 8, further including:

a first connector engaged to the appendage; and a second connector engaged to rear facet of the box, the second connector being complementary to the first connector, such that the second connector is positioned for selectively engaging the first connector for removably engaging the box to the appendage.

10. The sanitary wipe dispensing assembly of claim 9, wherein the second connector comprises a bracket, the first connector comprising a bracket receiver.

11. A sanitary wipe dispensing system comprising:

a container of sanitary wipes;

a box having a rear facet, a front facet, opposed vertical facets, and opposed horizontal facets, one of the front facet, the opposed vertical facets, and a first one of the opposed horizontal facets being open and positioned for insertion of the container of sanitary wipes, the box being configured for mounting to a substantially vertical surface proximate to a toilet, such that the rear facet abuts the substantially vertical surface;

an aperture positioned in a second one of the opposed horizontal facets, such that the aperture is positioned for protrusion of a sanitary wipe;

a cover hingedly engaged to the box, the cover being selectively engageable to the box, such that the cover is positioned for selectively covering the aperture and a sanitary wipe protruding through the aperture, wherein the cover is configured for retaining moisture in the sanitary wipes;

a roll of toilet paper;

a holder plate, the holder plate being configured for mounting to the substantially vertical surface proximate to the toilet and below the box;

a pair of arms, each arm being engaged to and extending from a respective opposed side of the holder plate;

a pair of recesses, each recess being positioned in a respective arm distal from the holder plate, such that the pair of recesses are facing;

a cylinder, the cylinder being hollow, the cylinder comprising a pair of nested segments;

a spring positioned in the cylinder and being engaged to each of the nested segments, such that the cylinder is biased to an elongated configuration, such that the cylinder is positioned for insertion through a tube of the roll of toilet paper, wherein the spring is configured for compressing, positioning the cylinder for placement between the arms, such that opposed ends of the cylinder insert into the recesses upon rebounding of the spring, such that the cylinder is removably engaged to the arms; and wherein the cover is pivotally coupled to the box proximate the rear facet, the cover having a length extending away from the box such that the cover extends beyond the cylinder when pivoted whereby the cover is positioned between the sanitary wipe and the roll of toilet paper when the cover is pivoted.

12. The sanitary wipe dispensing system of claim 11, wherein the holder plate comprises an extension of the rear facet.

13. The sanitary wipe dispensing system of claim 11, further including a mounting plate, the mounting plate being:

configured for mounting to a substantially vertical surface proximate to the toilet, the box being configured for mounting to the mounting plate; or comprising an appendage of the holder plate, a first connector being engaged to the appendage, a second connector being engaged to rear facet of the box, the second connector being complementary to the first connector, such that the second connector is positioned for selectively engaging the first connector for removably engaging the box to the appendage.

14. A sanitary wipe dispensing assembly comprising:

a box having a rear facet, a front facet, opposed vertical facets, and opposed horizontal facets, one of the front facet, the opposed vertical facets, and a first one of the opposed horizontal facets being open and configured for insertion of a container of sanitary wipes, the box being configured for mounting to a substantially vertical surface proximate to a toilet, such that the rear facet abuts the substantially vertical surface;

an aperture positioned in a second one of the opposed horizontal facets, wherein the aperture is configured for protrusion of a sanitary wipe, the first one of the opposed horizontal facets being open;

a lid hingedly engaged to the box, the lid being selectively engageable to the box, such that the lid is positioned for selectively covering the open one of the front facet, the opposed vertical facets, and the first one of the opposed horizontal facets, wherein the lid is configured for retaining moisture in the sanitary wipes;

a cover hingedly engaged to the box, the cover being selectively engageable to the box, such that the cover is positioned for selectively covering the aperture and a sanitary wipe protruding through the aperture, wherein the cover is configured for retaining moisture in the sanitary wipes;

a fastener engaged to one of the box and the cover and being configured for selectively engaging the other of the box and the cover, such that the fastener is positioned for securing the cover over the aperture, the fastener comprising a magnet;

a holder plate, the holder plate being configured for mounting to the substantially vertical surface proximate to the toilet and below the box, the holder plate comprising a perimeter section and a center section, the center section extending arcuately from the perimeter section, such that the center section is shaped complementarily to a portion of a roll of toilet paper;

a plurality of holes positioned in the holder plate, wherein the holes are configured for insertion of mounting hardware for securing the holder plate to the substantially vertical surface proximate to the toilet;

a pair of arms, each arm being engaged to and extending from a respective opposed side of the holder plate;

a pair of recesses, each recess being positioned in a respective arm distal from the holder plate, such that the pair of recesses are facing;

a cylinder, the cylinder being hollow, the cylinder comprising a pair of nested segments;

a spring positioned in the cylinder and being engaged to each of the nested segments, such that the cylinder is biased to an elongated configuration, wherein the cylinder is configured for insertion through a tube of a roll of toilet paper, wherein the spring is configured for compressing, positioning the cylinder for placement between the arms, such that opposed ends of the cylinder insert into the recesses upon rebounding of the spring, such that the cylinder is removably engaged to the arms;

wherein the cover is pivotally coupled to the box proximate the rear facet, the cover having a length extending away from the box such that the cover extends beyond the cylinder when pivoted whereby the cover is configured for extending between the sanitary wipe and the roll of toilet paper when the cover is pivoted;

a mounting plate, the box being configured for mounting to the mounting plate; and a plurality of orifices positioned in the mounting plate, wherein the orifices are configured for insertion of mounting hardware for securing the mounting plate to the substantially vertical surface proximate to the toilet.

15. The sanitary wipe dispensing assembly of claim 14, wherein the holder plate comprises an extension of the rear facet.

16. The sanitary wipe dispensing assembly of claim 14, further including:

the mounting plate comprising an appendage of the holder plate;

a first connector engaged to the appendage; and a second connector engaged to rear facet of the box, the second connector being complementary to the first connector, such that the second connector is positioned for selectively engaging the first connector for removably engaging the box to the appendage, the second connector comprising a bracket, the first connector comprising a bracket receiver.

* * * * *